United States Patent [19]

Naitoh

[11] Patent Number: 5,018,484

[45] Date of Patent: May 28, 1991

[54] COOLING FAN CONTROLLING APPARATUS

[75] Inventor: Takao Naitoh, Tokyo, Japan

[73] Assignee: Fuji Jukogyo Kabushiki Kaisha, Tokyo, Japan

[21] Appl. No.: 524,440

[22] Filed: May 17, 1990

[30] Foreign Application Priority Data

May 18, 1989 [JP] Japan ..... 1-125189

[51] Int. Cl.[5] ..... F01P 7/02

[52] U.S. Cl. ..... 123/41.12

[58] Field of Search ..... 123/41.01, 41.02, 41.12, 123/41.11

[56] References Cited

U.S. PATENT DOCUMENTS

| | | | |
|---|---|---|---|
| 4,425,766 | 7/1984 | Claypole | 123/41.12 |
| 4,590,772 | 5/1986 | Nose et al. | 123/41.12 |
| 4,590,892 | 5/1986 | Nose et al. | 123/41.12 |
| 4,651,922 | 3/1987 | Noba | 123/41.12 |

*Primary Examiner*—Noah P. Kamen

*Attorney, Agent, or Firm*—Beveridge, DeGrandi & Weilacher

[57] ABSTRACT

An apparatus for controlling an electric cooling fan of an automotive vehicle with an engine, having a radiator facing the electric cooling fan for cooling the engine coolant, comprising a device for generating an engine start signal, a coolant temperature sensor for sensing the engine coolant temperature, a judgement device responsive to the engine start signal for comparing the coolant temperature with a preset temperature, and generating a first judgement signal when the coolant temperature is lower than the preset temperature, a cooling fan control temperature setting device responsive to the first judgement signal for setting a cooling fan control temperature in accordance with the coolant temperature, the cooling fan control temperature being set higher with lower coolant temperature at the engine start, a temperature judging device for comparing the cooling fan control temperature with the coolant temperature after engine start and for outputting a second judgement signal, and a device responsive to the second judgement signal for driving the cooling fan.

7 Claims, 7 Drawing Sheets

FIG. 6(a)
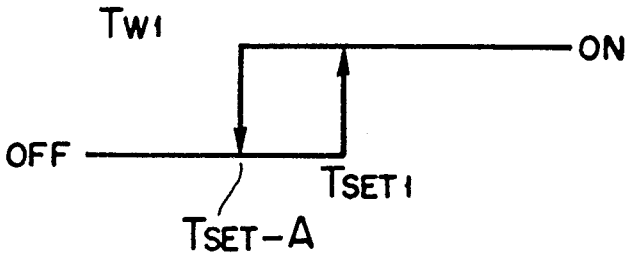
FIG. 6(b)
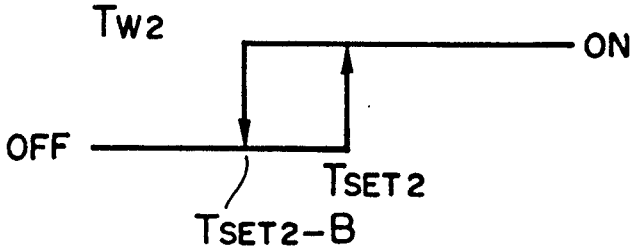
FIG. 6(c)
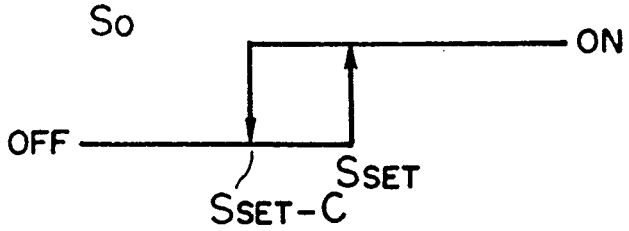
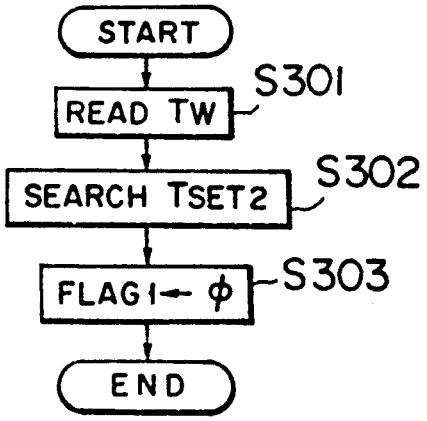
FIG. 8

COOLING FAN CONTROLLING APPARATUS

BACKGROUND OF THE INVENTION

The present invention relates to a cooling fan controlling apparatus for controlling an electric cooling fan used with a radiator in an automotive vehicle.

In a conventional down-flow type cooling system of an engine, coolant from the radiator and the coolant returned from a heater line are supplied to a coolant inlet of the engine by a pump. The coolant heated by the engine is returned to the radiator from the upper portion of the engine. A line interconnecting the radiator and the coolant inlet is opened and closed by a thermostat.

The open/closed operation of the thermostat is dependent upon a temperature of the returning coolant from the heater line. At an outside air temperature in winter or in a cold region which requires the use of a heater, the in the heater coolant cooled through heat exchange with indoor blowing air contacts the thermostat so that the temperature of the thermostat becomes lower than a set value, thereby causing a low frequency of opening of the thermostat.

In contrast, at ordinary outside air temperatures not using the heater or at a high outside air temperature, the coolant heated in the engine does not pass the heater without the heat exchange with the indoor blowing air, and contact the thermostat, so that the temperature of the thermostat becomes higher than the set value, thereby causing a high frequency of opening of the thermostat.

The frequency of opening of the thermostat is less at the low outside air temperature than at the ordinary outside air temperature or at high temperature. Accordingly, the amount of the coolant supplied from the radiator to the engine is reduced at the low outside air temperature, whereas the temperature at the coolant outlet of the engine becomes relatively high.

The cooling fan for the radiator begins operation when the coolant temperature reaches a predetermined set value, the coolant temperature being detected by a coolant temperature sensor which is mounted on a line near the coolant outlet of the engine because the engine temperature is estimated from the coolant temperature.

Therefore, the frequency of operations of the cooling fan becomes high at low outside air temperatures, and there arises a problem of high noise level.

The cooling effect of the cooling fan changes with the outside air temperature even if the same amount of inside blowing air is used. It is obvious that the coolant temperature decreases faster at the low outside air temperature than at high outside air temperatures even if the cooling fan is driven at the same rotation speed.

Therefore, at low outside air temperatures with a high frequency of operations of the cooling fan, there is no danger to engine overheating due to a rise of the coolant temperature. In such a case, unnecessary energy loss is generated if the cooling fan is driven at the same set temperature as the ordinary outside air temperature or high temperature having a relatively low frequency of operations of the cooling fan.

In order to solve these problems, there is proposed in Japanese Patent Laid-open Publication No. 58-192917 a coolant temperature switch using a wax and having a plurality of contacts wherein one of the power supply lines to the cooling fan motor is selected in accordance with an outside air temperature to change the coolant temperature at which the cooling fan motor is operated.

With this prior art, however, it is necessary to use an outside air temperature detector. In addition, the coolant temperature for initiating the cooling fan motor is changed by selecting the contact of the coolant temperature switch in accordance with the outside air temperature. Therefore, if the coolant temperature is required to be set with precision, the number of contacts of the coolant temperature switch becomes large, resulting in a complicated structure and low reliability. Further, the precise control is not attained because the coolant temperature switch is the mechanical switch using the wax.

SUMMARY OF THE INVENTION

The present invention has been made in consideration of the above circumstances. It is an object of the present invention to provide a cooling fan controlling apparatus wherein a operating temperature of cooling fans is changed in accordance with a coolant temperature, the operation frequency of the cooling fans is reduced to suppress noises and avoid unnecessary energy consumption while attaining high precision and high reliability.

In order to achieve the above object, the present invention provides an apparatus for controlling an electric cooling fan of an automotive vehicle with an engine, having a radiator facing to the electric cooling fan for cooling a coolant of the engine, comprising: a device for generating an engine start signal; a coolant temperature sensing device for sensing a coolant temperature of the engine; a judgment device responsive to the engine start signal for comparing the coolant temperature with a preset temperature, and generating a first judgment signal when the coolant temperature is lower than said preset temperature; a cooling fan control temperature setting device responsive to the first judgment signal for setting a cooling fan control temperature in accordance with the coolant temperature, the cooling fan control temperature set higher with lower coolant temperature at the engine start; a temperature judging device for comparing the cooling fan control temperature with the coolant temperature after the engine start and for outputting a second judgment signal; and a device responsive to the second judgment signal for driving the cooling fan.

BRIEF DESCRIPTION OF THE DRAWINGS

FIG. 6 are characteristic diagrams showing reference values for judging the operation of cooling fans;

FIGS. 7 to 9 show the second embodiment of the invention;

FIG. 7 is a functional block diagram;

FIG. 8 is a flow chart of the initialization procedure of the control unit;

FIG. 9 is a cooling fan control temperature map; and

DETAILED DESCRIPTION OF THE PREFERRED EMBODIMENTS

Structure of Engine Cooling System

Figure 1:
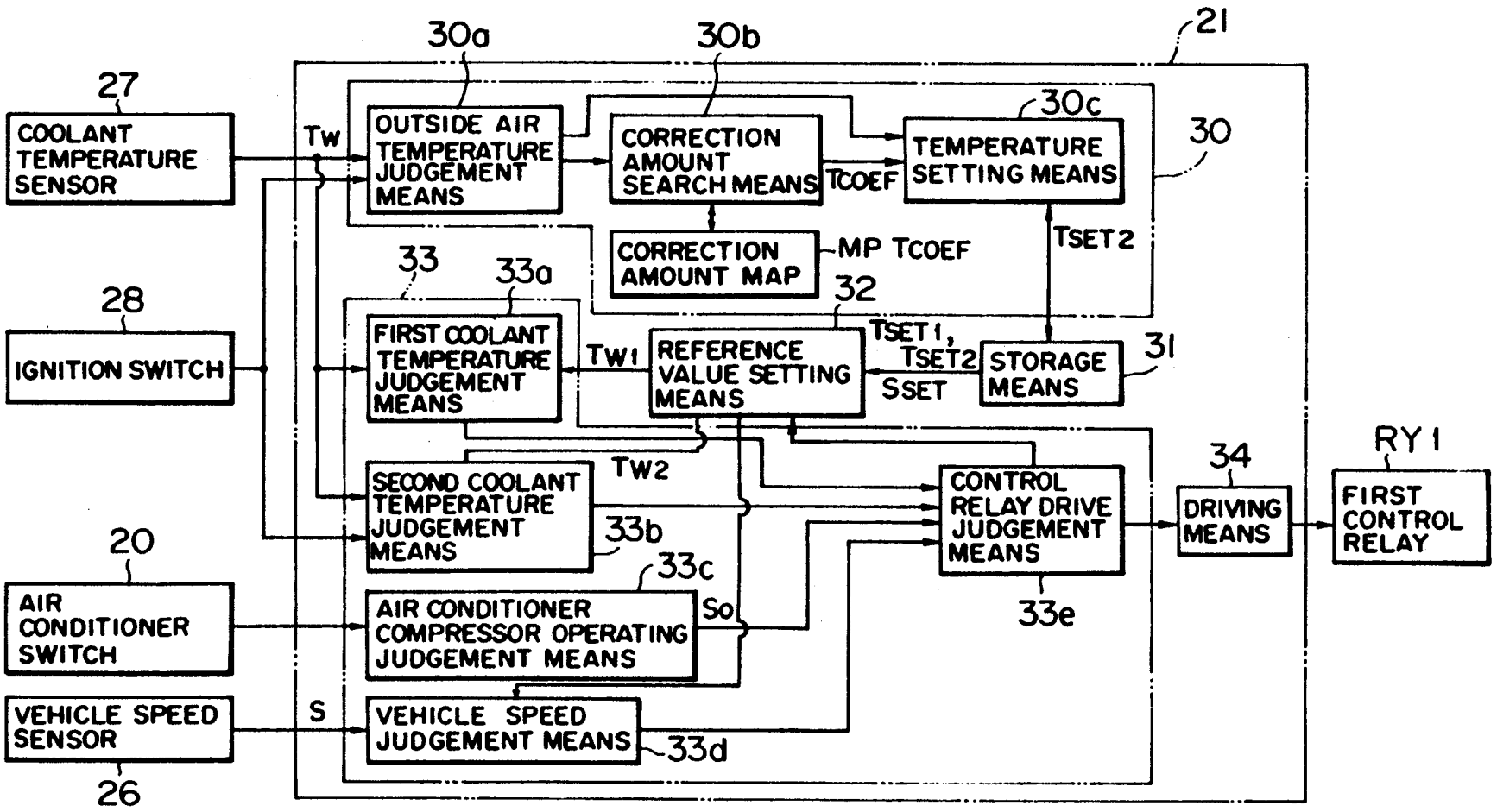
FIG. 1 is a functional block diagram showing a cooling fan controlling apparatus according to the invention.
Figure 2:
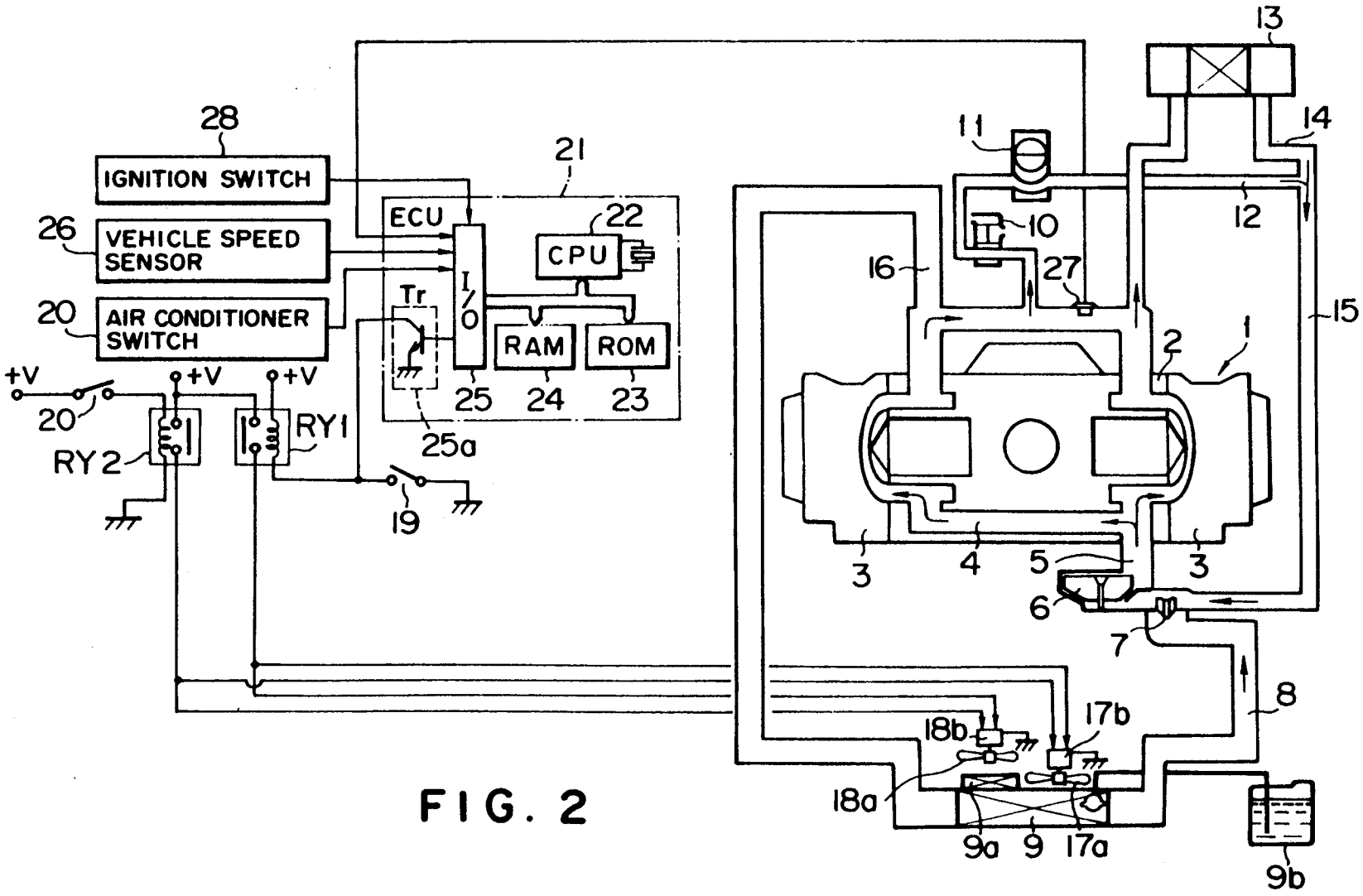
FIG. 2 is a schematic diagram showing an engine cooling system.

Referring to FIG. 2, reference numeral 1 represents an engine main body of a horizontal opposed type engine. A water jacket 4 is formed in the cylinder block 2 and cylinder heads 3 at right and left banks of the engine main body 1. A coolant inlet 5 of the water jacket 4 is communicated with a discharge opening of a water pump 6. The coolant system is a down-flow type.

At a suction opening of the water pump 6 there is mounted a thermostat 7 of which the inlet side is in communication with a radiator 9 via a coolant line 8.

A line 12 from the water jacket 4 to an idle control valve 10 and a throttle body 11, and a heater line 14 from the water jacket 4 to a heater 13 are combined into a circulation line 15 which is in communication with the outlet of the thermostat 7 and the suction opening of the water pump 6. The coolant outlet of the water jacket 4 is in communication with the radiator 9 via a return line 16.

A main cooling fan 17*a* and a sub cooling fan 18*a* are mounted facing the radiator 9 and driven by fan motors 17*b* and 18*b*, respectively. An air conditioner condensor 9*a* is mounted on the side of the sub cooling fan 18*a*.

A reservoir tank 9*b* is provided as a reservoir for coolant which has overflown from the radiator 9.

The fan motors 17*b* and 18*b* are compound-wound motors. Compound-wound coils of the motors are connected respectively via relay contacts of first and second control relays RY1 and RY2 to a power source +V. The motors are deactivated when the relay contacts of both the first and second control relays RY1 and RY2 are opened. The motor speed is switched between two steps, i.e., at a low speed when one of the relay contacts of the first and second control relays RY1 and RY2 is closed, and at a high speed when the relay contacts of both the first and second control relays RY1 and RY2 are closed.

A coil of the first control relay RY1 has one end terminal connected to the power source +V and the other end terminal grounded via a refrigerant pressure switch 19. A coil of the second control relay RY2 has one end terminal connected to an air conditioner switch 20 and the other terminal grounded.

The refrigerant pressure switch 19 is closed when a refrigerant pressure of the air conditioner reaches or exceeds a predetermined value, i.e., when the load of the air conditioner is high.

An electric control unit (ECU) 21 is constructed of a microcomputer having a CPU 22, a ROM 23, a RAM 24 and an I/O 25.

The input port of the I/O 25 is connected to an ignition switch 28, a vehicle speed sensor 26, the air conditioner switch 20, and a coolant temperature sensor 27 mounted near a coolant outlet of the water jacket 4. The output port of I/O 25 is connected to driving means 25*a* such as a transistor TR which is connected to the coil of the first control relay RY1 in parallel with the refrigerant pressure switch 19.

Function of ECU 21

The control functions of ECU 21 for controlling the main and sub cooling fans 17*a* and 18*a* are carried out by cooling fan control temperature setting means 30, storage means 31, reference value setting means 32, cooling fan drive judging means 33 and driving means 34.

The cooling fan control temperature setting means 30 is constructed of outside air temperature judgment means 30*a*, correction amount searching means 30*b*, a correction amount map MPTcoef, and temperature setting means 30*c*. The cooling fan drive judgment means 33 is constructed of first coolant temperature judgment means 33*a*, second coolant temperature judgment means 33*b*, air conditioner compressor operating judgment means 33*c*, vehicle speed judging means 33*d* and control relay drive judging means 33*e*.

In the cooling fan control temperature setting means 30, the outside air temperature judgment means 30*a* compares the coolant temperature Tw detected by the coolant temperature sensor 27 with a predetermined set value $Tw_0$ (e.g., 10° C.) at engine start. If $Tw < Tw_0$, the judging means 30*a* judgment that the outside air temperature is low and then output the result representing a low temperature state to the temperature setting means 30*c* and the correction amount searching means 30*b*. At a cold start of the engine 1, the coolant temperature is nearly equal to the outside air temperature.

Upon the result from the outside air temperature judgment means 30*a*, the correction amount searching means 30*b* searches a correction amount Tcoef from the correction amount map MPTcoef using as a parameter the coolant temperature Tw detected by the coolant temperature sensor 27. The searched correction amount Tcoef is outputted to the temperature setting means 30*c*.

Figure 5:
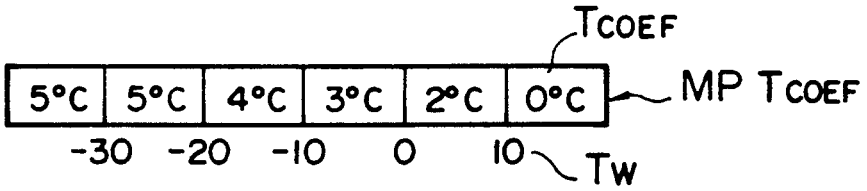
FIG. 5 is a correction amount map.

As shown in FIG. 5, the correction amount map MPTcoef stores therein a plurality of correction amounts Tcoef for the control temperature of the cooling fans 17*a* and 18*a*, the correction amounts being stored using as a parameter the coolant temperature Tw at the time of engine start, and being used when Tw is $Tw_0$ or lower. The lower the coolant temperature Tw, the larger the correction amount Tcoef is set.

When the outside air temperature judgment means 30*a* judges that the outside air temperature is low, the temperature setting means 30*c* adds an initial value $Tset_0$ of the cooling fan control temperature to the correction amount Tcoef searched by the correction amount searching means 30*b*, to thereby set a second control temperature $Tset_2$ ($=Tset_0+Tcoef$) as the cooling fan control temperature. The initial value $Tset_0$ is stored for 95° C. in ROM 23 of the memory means 31 which also includes RAM 24. The initial value $Tset_0$ is used as the initial value for the second control temperature $Tset_2$ which is used under normal control conditions.

As another cooling fan control temperature, a first control temperature $Tset_1$ is stored for 120° C. in the memory means 31 (ROM 23). The first control temperature $Tset_1$ is used for driving the cooling fans 17*a* and 18*a* in the case of such as engine overheating.

When the outside air temperature judgment means 30*a* judges that the outside air temperature at engine start is not low, the initial value $Tset_0$ is used as the second control temperature $Tset_2$ without adding the correction amount.

The newly set second control temperature $Tset_2$ is stored in the memory means 31 (RAM 24).

While referring to the output state of a drive signal for the first control relay RY1 from the cooling fan drive judgment means 33, the reference value setting means 32 sets a first reference value $Tw_1$, a second reference value $Tw_2$, and a reference vehicle speed $S_0$ in accordance with the first and second control temperatures $Tset_1$ and $Tset_2$ and a set vehicle speed Sset (e.g., 20 km/h) stored in ROM 23.

In particular, under the condition that the drive signal is not outputted for the first control relay RY1, i.e., the cooling fans 17*a* and 18*a* are not driven by the fan motors 17*b* and 18*b*, the first control temperature $Tset_1$ is set as the first reference value $Tw_1$, the second control temperature $Tset_2$ as the second reference value $Tw_2$, and the set vehicle speed Sset as the reference vehicle speed $S_0$.

On the other hand, under the condition that the drive signal is outputted for the first control relay RY1, i.e., the cooling fans 17*a* and 18*a* are driven by the fan motors 17*b* and 18*b*, the first control temperature $Tset_1$ subtracted mined value A (e.g., 37° C.) is set as the first reference value as shown in FIG. 6(*a*), the second control temperature $Tset_2$ subtracted by a predetermined value B (e.g., 6° C.) as the second reference value $Tw_2$ as shown in FIG. 6(*b*), and the set vehicle speed Sset (e.g., 20 km/h) subtracted by a predetermined value C (e.g., 10 km/h) as the reference vehicle speed $S_0$. Since the reference values used at driving state of the cooling fans 17*a* and 18*a* are larger than those used at not driving state thereof, there is presented a hysteresis between when the cooling fans are driven and when the fans are not driven so that hunting can be avoided.

In the cooling fan drive judgment means 33, the first coolant temperature judgment means 33*a* compares the coolant temperature Tw from the coolant temperature sensor 27 with the first reference value $Tw_1$ set by the reference value setting means 32. The comparison result is outputted to the control relay drive judgment means 33*e*.

The second coolant temperature judgment means 33*b* compares the coolant temperature Tw from the coolant temperature sensor 27 with the second reference value $Tw_2$ set by the reference value setting means 32, and outputs the comparison result to the control relay drive judgment means 33*e*.

The air conditioner compressor operating judgment means 33*c* judges from a signal supplied from the air conditioner switch 20 whether the air conditioner compressor (not shown) is operating or not, and outputs the judgment result to the control relay drive judgment means 33*e*.

The vehicle speed judgment means 33*d* compares the vehicle speed S detected by the vehicle speed sensor 26 with the reference vehicle speed $S_0$ set by the reference value setting means 32, and outputs the comparison result to the control relay drive judgment means 33*e*.

In accordance with the parameters representative of conditions supplied from the first and second coolant temperature judgment means 33*a* and 33*b*, the air conditioner compressor operating judgment means 33*c* and the vehicle speed judgment means 33*d*, the control relay drive judgment means 33*e* judges if the drive signal for the cooling fans 17*a* and 18*b* should be supplied or not, i.e., if the first control relay RY1 should be driven. The judgment result is outputted to the driving means 34.

If an output from the first coolant temperature judgment means 33*a* indicates $Tw \geqq Tw_1$ (e.g., 120° C.), that is overheating state of the engine, an ON signal is immediately outputted to the driving means 34, resulting in driving the coolant fans 17*a* and 18*b*. If an output from the second coolant temperature judgment means 33*b* indicates $Tw < Tw_2$, then an OFF signal is outputted.

On the other hand, if outputs from the first and second coolant temperature judgment means 33*a* and 33*b* indicate $Tw < Tw_1$ and $Tw \geqq Tw_2$, respectively, an ON signal or OFF signal is outputted depending upon the conditions supplied from the air conditioner compressor operating judgment means 33*c* and the vehicle speed judging means 33*d*.

Specifically, if $S \geqq S_0$, the first control relay RY1 is turned on. If $S < S_0$ and the air conditioner switch 20 is turned off, the first control relay RY1 is turned on. If $S < S_0$ and the air conditioner switch 20 is turned on, the first control relay RY1 is turned off.

Initialization Procedure of ECU

Figure 3:
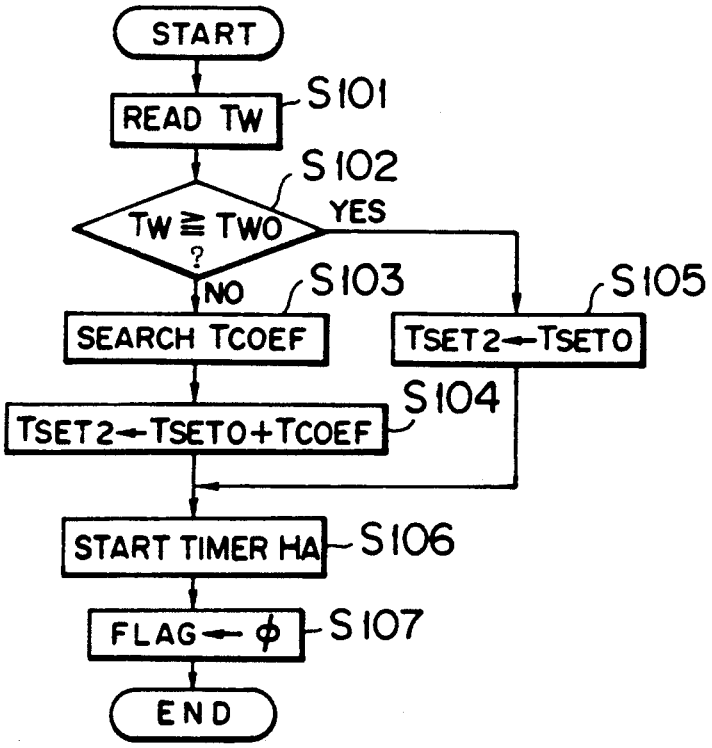
FIG. 3 is a flow chart showing the initialization procedure of the control apparatus.

When the engine starts running upon turning on the ignition switch 28, the ECU 21 executes an initialization routine shown in FIG. 3 prior to controlling the main and sub cooling fans 17*a* and 18*a*. The procedure of the initialization routine will be described with reference to the flow chart shown in FIG. 3.

At a step S101, the coolant temperature Tw at the time of engine start is read from the coolant temperature sensor 27. Next at step S102 the coolant temperature Tw is compared with the predetermined value $Tw_0$ (e.g., 10° C.).

If $Tw < Tw_0$ at step S102, then at step S103 a correction amount Tcoef is searched from the correction map MPTcoef using as a parameter the read coolant temperature Tw.

At step S104, the initial value $Tset_0$ of the cooling fan driving temperature (e.g., $Tset_0 = 95°$ C.) stored in ROM 23 is corrected with the correction amount Tcoef searched at step S103 to obtain the second control temperature $Tset_2$ ($= Tset_0 + Tcoef$) which is stored in the RAM 24. A timer HA is caused to start at step S106. The timer HA counts a time after the second control temperature $Tset_2$ is set.

On the other hand, if $Tw \geqq Tw_0$ at the step S102, the flow advances to a step S105 whereat the initial value $Tset_0$ of the cooling fan driving temperature is used as the second control temperature $Tset_2$ which is stored in RAM 24. The timer HA is caused to start at step S106.

At step S107, a cooling fan control flag FLAG is cleared to "0" indicating that the cooling fan driving signal from ECU 21 is an OFF signal. Then, the initializing routine is terminated.

In summary, if the coolant temperature Tw is lower than the set value $Tw_0$, it is judged that the outside air temperature is low so that the initial value $Tset_0$ of the cooling fan driving temperature stored in ROM 23 is corrected in accordance with the coolant temperature Tw to thereby set the second control temperature $Tset_2$. As described previously, the lower the coolant temperature Tw, the larger correction amount Tcoef is searched from the correction map MPTcoef. Therefore, the lower the coolant temperature Tw at the time of engine start, the higher the second control temperature $Tset_2$ is set.

On the other hand, if the coolant temperature is the set value $Tw_0$ or higher, the correction is not effected and the initial value $Tset_0$ of the cooling fan driving temperature is used as the second control temperature $Tset_2$ without the correction.

Without using the outside air temperature sensor, the temperature at which the cooling fans 17*a* and 18*a* for the radiator 9 are operated can be precisely set in accordance with the coolant temperature Tw at the time of engine start, i.e., in accordance with the outside air temperature.

Figure 10:
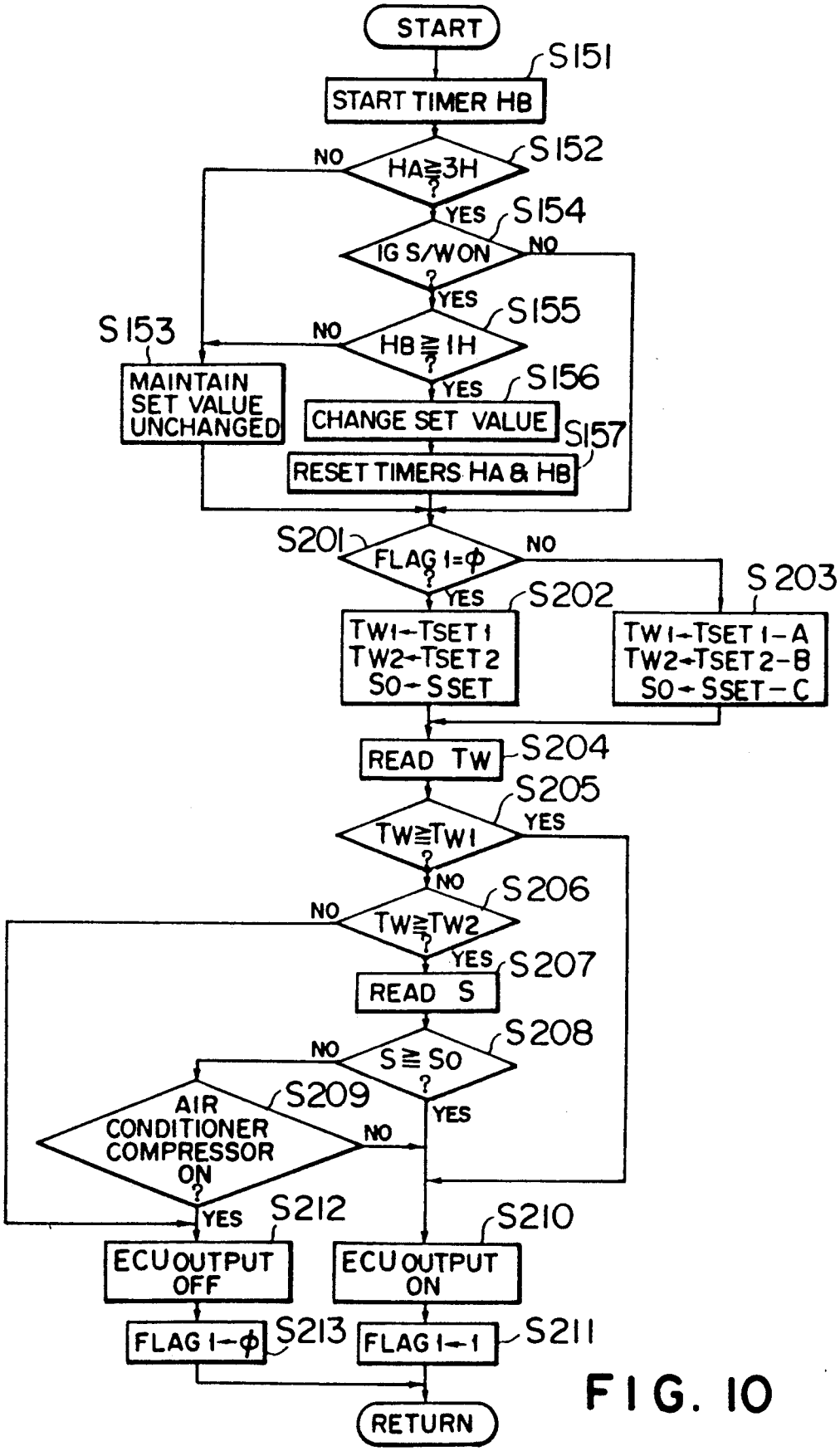
FIG. 10 is a flow chart for determining restart state of the engine.

It is to be noted, the coolant temperature Tw used at the step S102 in FIG. 3 must be equal to the outside air temperature. However, in the case that the engine 1 is restarted, the coolant temperature may still be high even if the outside air temperature is low, so as to set inaccurate second control temperature $Tset_2$. Accordingly, it is necessary to determine whether the coolant temperature has become the same as the outside air temperature. FIG. 10 shows the operation of the control system at turning off the ignition switch for determining the restart of the engine 1.

After a timer HB is caused to start (step S151), the elapsed time HA from previously turning on the ignition switch is measured. A step S152 checks if the elapsed time HA exceeds a predetermined time, e.g., 3 hours. If not, at step S153 the next initialization procedure (FIG. 3) for the second control temperature is prohibited to maintain a previous second control temperature. If the elapsed time HA exceeds the predetermined time, it is checked at step S155 if the ignition switch IG is turned on again. If in an off-state of the switch IG, the flow ends. If in an on-state, at step S155 it is checked if the time counted by the timer HB exceeds a predetermined time, e.g., one hour. If the time exceeds, it is considered that the coolant temperature has reached near the outside air temperature so that step S157 allows the initialization procedure to set the second control temperature. If not, the flow advances to step S153 to prohibit the next initialization procedure. The judgment at step S152 for judging the lapsed time HA from the previous setting of the second control temperature $Tset_2$ may be omitted. The times HA and HB may be set arbitrarily.

Control Procedure for Cooling Fans

Figure 4:
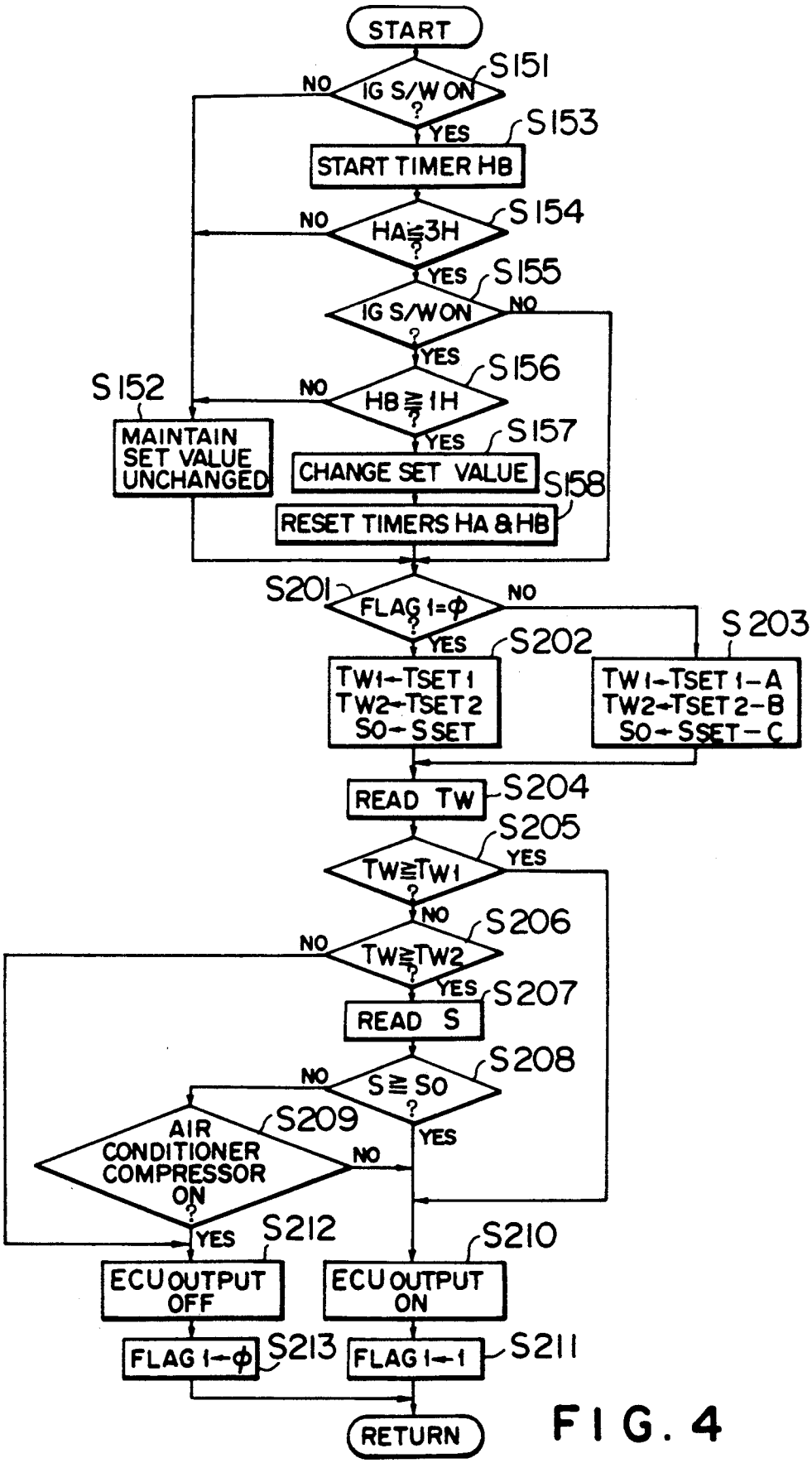
FIG. 4 is a flow chart showing the control procedure of cooling fans.

Upon termination of the initialization routine described above, the program shown as the flow chart in FIG. 4 runs at ECU 21 to thereby control the operation of the cooling fans 17*a* and 18*a*.

At step S201 with reference to the cooling fan control flag FLG, it is checked if the cooling fan control flag has been cleared or not, i.e., if the cooling fan driving signal is the OFF signal (FLAG=0) or an ON signal (FLAG=1).

If the cooling fan control flag FLAG is 0, i.e., if the cooling fan driving signal is the OFF signal, then the flow advances to step S202. At step S202, the first control temperature $Tset_1$ stored in ROM 23 is set as the first reference value $Tw_1$, the second control temperature $Tset_2$ set by the initializing routine is set as the second reference value $Tw_2$, and the set vehicle speed Sset (e.g., 20 km/h) stored in ROM 23 as the reference vehicle speed $S_0$. Thereafter, the flow advances to step S204.

If the cooling fan control flag FLAG is "1" at step S201, i.e., if the cooling fan driving signal is the ON signal, the flow advances to step S203. At step S203, the first control temperature subtracted by the predetermined value A (e.g., 37° C.) is set as the first reference value $Tw_1$, the second control temperature $Tset_2$ subtracted by the predetermined value B (e.g., 6° C.) as the second reference value $Tw_2$, and the set vehicle speed Sset (e.g., 20 km/h) subtracted by the predetermined value C (e.g., 10 km/h) as the reference vehicle speed $S_0$. Thereafter the flow advances to step S204.

At step S204, the coolant temperature Tw is read from the coolant temperature sensor 27. At step S205 the coolant temperature read at step S204 is compared with the first reference value $Tw_1$ set at step S202 or step S203. The first control temperature $Tw_1$ is used for an emergency case. Namely, when the coolant temperature Tw is $Tset_1$ (e.g., 120° C.) or higher and the engine is just before overheating or in overheating state, the flow jumps to step S210 whereat the output port of the I/O 25 in the ECU 21 is made high level to turn on the transistor TR. As a result, the contact of the first control relay RY1 is closed to drive the fan motors 17*b* and 18*b* of the cooling fans 17*a* and 18*a* until the coolant temperature Tw is sufficiently cooled, i.e., until $Tw < Tw_1 = Tset_1 - A$ (e.g., 120° C.−37° C.=83° C.).

If $Tw < Tw_1$ at step S205, then at Step S206 the coolant temperature Tw is compared with the second comparison reference value $Tw_2$ set at step S202 or step S203. If $Tw < Tw_2$, then the flow jumps to a step S212 whereat the output port of the I/O 25 in the ECU 21 is made low level to maintain the transistor Tr turned off. On the other hand, if $Tw \geqq Tw_2$, the flow advances to step S207.

At step S207, the vehicle speed S is read by the vehicle speed sensor 26. At step S208 the read vehicle speed S is compared with the reference vehicle speed $S_0$ set at step S202 or step S203.

If $S \geqq S_0$ at the step S208, the flow advances to a step S210 whereat the output port of the I/O 25 in the ECU 21 is made high level to turn on the transistor TR. The contact of the first control relay RY1 is therefore closed so that the fan motors 17*b* and 18*b* of the cooling fans 17*a* and 18*a* are driven. At step S211 the cooling fan control flag FLAG is set to "1" to leave this routine.

If $S < S_0$ at step S208, at step S209 it is checked whether the air conditioner switch 20 is in the on-state or not.

If the air conditioner switch 20 is in the off-state, at the step S210 the contact of the first control relay RY1 is closed to drive the cooling fans 17*a* and 18*a*. If the air conditioner switch 20 is in the on-state, the cooling fans 17*a* and 18*a* are now operating by means of second control relay RY2 so that at the step S212 the output port of the I/O 25 in the ECU 21 is made low level to turn off the transistor TR. Next at step S213 the cooling fan control flag FLAG is set to "0" to leave this routine.

There is shown in Table 1 the relationship among the running condition parameters, an output of ECU 21, and the operation conditions of the first and second control relays RY1 and RY2 and the cooling fans 17*a* and 18*a*. It is readily understood from Table 1 that the cooling fans 17*a* and 18*a* are driven at an optimum state in accordance with running conditions.

TABLE 1

| COOLANT TEMPERATURE | VEHICLE SPEED | AIR CONDITIONER COMPRESSOR SW | ECU OUTPUT | REFRIGERANT PRESSURE SW | RY1 | RY2 | COOLING FAN |
|---|---|---|---|---|---|---|---|
| $Tw \geqq Tw_2$ | $S \geqq S_0$ | ON | ON | ON | ON | ON | High |
| | | | | OFF | ON | ON | High |
| | | OFF | ON | ON | ON | OFF | Low |
| | | | | OFF | ON | OFF | Low |
| | $S \leqq S_0$ | ON | OFF | ON | ON | ON | High |

TABLE 1-continued

| COOLANT TEMPERATURE | VEHICLE SPEED | AIR CONDITIONER COMPRESSOR SW | ECU OUTPUT | REFRIGERANT PRESSURE SW | RY1 | RY2 | COOLING FAN |
|---|---|---|---|---|---|---|---|
| | | | | OFF | OFF | ON | Low |
| | | OFF | ON | ON | ON | OFF | Low |
| | | | | OFF | ON | OFF | Low |
| $Tw \leqq Tw_2$ | — | ON | OFF | ON | ON | ON | High |
| | | | | OFF | OFF | ON | Low |
| | | OFF | OFF | ON | ON | OFF | Low |
| | | | | OFF | OFF | OFF | OFF |

(ECU output is made on during engine overheating of $Tw \geqq Tw_1$)

As seen from Table 1, during the normal state of $Tw < Tw_1$ other than engine overheating, the cooling fans are controlled by the second reference value $Tw_2$ obtained on the basis of the second control temperature $Tset_2$. And if the coolant temperature Tw is lower than $Tw_2$, the ECU 21 does not deliver an output signal irrespective of the vehicle speed S and the operating condition of the air conditioner switch 20.

The operation frequency of the cooling fans can be reduced even if the coolant temperature sensor 27 is mounted at the coolant outlet side of the engine in a down-flow type coolant system. The reason for this is as follows. The outside air temperature is estimated from the coolant temperature at the time of engine start during the initialization procedure (at cooling fan control temperature setting means 30). If the engine is started in winter or in a cold place with the coolant temperature Tw being lower than the set value $Tw_0$, the second control temperature $Tset_2$ on the basis of the second reference value $Tw_2$ for the cooling fan control is set higher, as the coolant temperature Tw (or outside air temperature) becomes lower. Accordingly, the frequency of operations of the cooling fans can be reduced.

If the outside air temperature is low, the coolant temperature is rapidly cooled upon rotation of the cooling fans 17*a* and 18*a* so that there is an ample margin up to engine overheating. Therefore, there is no problem even if the second control temperature $Tset_2$ is set higher as the outside air temperature becomes higher.

Further, in setting the second control temperature $Tset_2$, the outside air temperature is estimated from the coolant temperature Tw at the time of engine start, and the correction amount for correcting the initial value $Tset_0$ of the cooling fan control temperature is searched from the correction amount map MPATcoef using as a parameter the coolant temperature Tw at the time of engine start. It is not necessary therefore to use the outside air temperature sensor and the like thus simplifying the structure. In addition, it is possible to obtain the precise cooling fan control temperature suitable for the outside air temperature, thereby allowing a highly reliable cooling fan control.

It is to be noted that the ECU 21 is adapted to deliver the ON signal when the vehicle speed sensor 26 and/or the coolant temperature sensor 27 becomes abnormal or has some trouble.

Figure 9:
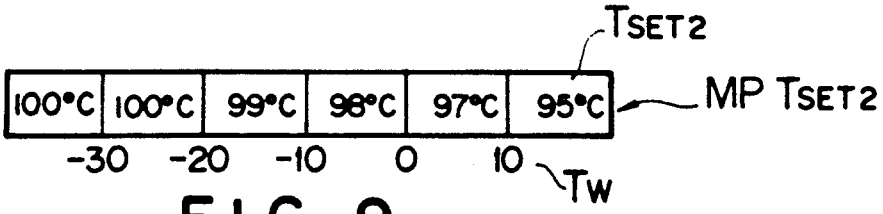
Figure 7:
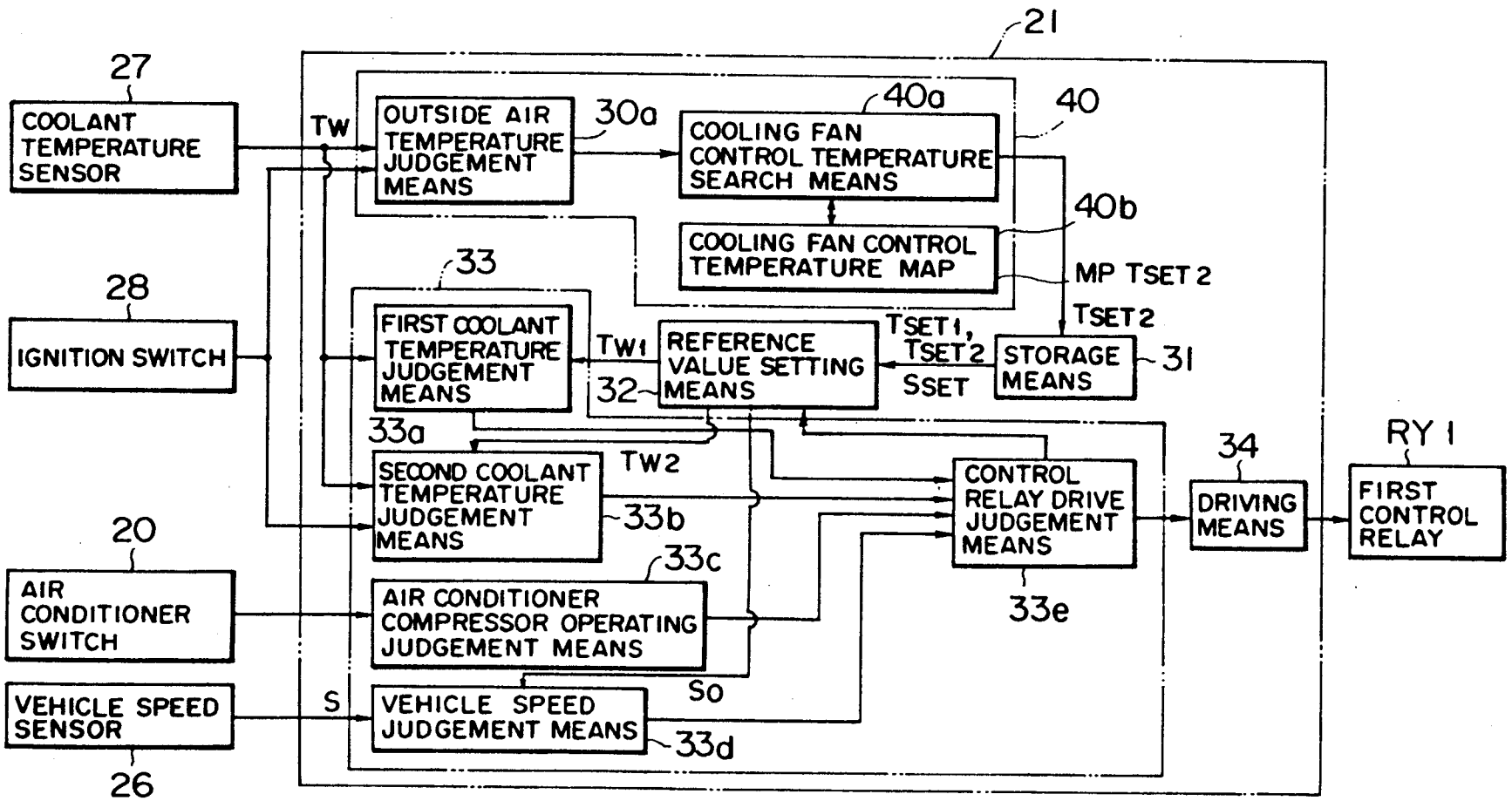

FIGS. 7 to 9 show the second embodiment of this invention. FIG. 7 is a functional block diagram, FIG. 8 is a flow chart showing the initialization procedure of the control unit, and FIG. 9 shows a cooling fan control temperature map.

The second embodiment simplifies the operation of the first embodiment in that the second control temperature $Tset_2$ for the cooling fans 17*a* and 18*a* is searched directly from the map.

Specifically, as shown in FIG. 7, cooling fan control temperature setting means 40 is constructed of outside air temperature judgment means 30*a*, cooling fan control temperature search means 40*a*, and cooling fan control temperature map $MPTset_2$, The other elements are the same as the first embodiment.

The cooling fan control temperature map $MPTset_2$ is constructed of a map of the second control temperature $Tset_2$ using as a parameter the coolant temperature Tw. The second control temperature $Tset_2$ is searched directly or interpolationally from the map by the cooling fan control temperature search means 40*a* in accordance with the coolant temperature Tw read at the outside air temperature judgment means 30*a*.

In the second embodiment constructed as above, the initialization routine is executed by the ECU 21 in accordance with the flow chart shown in FIG. 8.

Specifically, at a step S301 the coolant temperature Tw at the time of engine start is read from the coolant temperature sensor 27. At step S302 the second control temperature $Tset_2$ is searched from the cooling fan control temperature map MPS $Tset_2$ using as a parameter the coolant temperature, and stored in the RAM 24.

At step S303 the cooling fan control flag FLAG is cleared to "0" indicating that the cooling fan driving signal from the ECU 21 is turned off, to thereby terminate the initialization routine.

Upon completion of this initialization routine, the cooling fans 17*a* and 18*a* are controlled by the ECU 21 in a similar manner to the first embodiment.

As described in the foregoing description of the present invention, the cooling fan control apparatus comprises cooling fan control temperature setting means for comparing a coolant temperature at the time of engine start with a predetermined set value, and for setting a cooling fan control temperature in accordance with the coolant temperature if the coolant temperature is lower than the predetermined value, and driving means for driving a cooling fan when the coolant temperature is lower than the cooling fan control temperature, so as to thereby reduce the operation frequency of the cooling fan.

As a result, various advantages can be obtained such as reducing noises, avoiding unnecessary energy consumption, controlling the cooling fan control temperature at high precision and with high reliability.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. An apparatus for controlling an electric cooling fan of an automotive vehicle with an engine, having a radiator facing the electric cooling fan for cooling a coolant of the engine, comprising:

generating means for generating an engine start signal;

sensing means for sensing a first coolant temperature at the engine start and a second coolant temperature after the engine start;

judgment means responsive to said engine start signal for comparing said first coolant temperature with a preset temperature, and generating a first judgment signal when said first coolant temperature is lower than said preset temperature;

setting means responsive to said first judgment signal for setting a cooling fan control temperature, said cooling fan control temperature being set higher as said first coolant temperature becomes lower;

temperature judging means for comparing said cooling fan control temperature with said second coolant temperature and for outputting a second judgment signal; and driving means responsive to said second judgment signal for driving said cooling fan.

2. The apparatus according to claim 1, further comprising:

a coolant circuit for circulating the coolant between the engine and the radiator;

value means, provided on the coolant circuit near a coolant inlet of the engine, for opening said coolant circuit in response to a coolant temperature downstream thereof;

a heater circuit in communication with the coolant circuit at the downstream of the valve means and downstream of a coolant outlet of the engine; and a heater mounted on the heater circuit for performing heat exchange.

3. The apparatus according to claim 1, wherein said generating means is an ignition switch.

4. The apparatus according to claim 1, said setting means comprises:

memory means for storing an initial value of said cooling fan driving temperature;

a map for storing a plurality of correction values in dependency on the first coolant temperature;

detector means for retrieving one of the correction values from the map in accordance with the first coolant temperature; and calculator means for calculating the coolant fan control temperature by correcting the initial value with said one of the correction values.

5. The apparatus according to claim 1, further comprising:

means for permitting the next operation of said setting means when a predetermined time has elapsed after engine stop.

6. The apparatus according to claim 1, further comprising:

means for prohibiting the next operation of said setting means to keep a previous cooling fan control temperature when the engine is restarted within a predetermined time after engine stop.

7. The apparatus according to claim 1, wherein said comparing means is capable of generating a first result signal when said first coolant temperature is higher than said preset temperature, and said setting means is capable of setting a predetermined initial value as the cooling fan control temperature.

* * * * *

UNITED STATES PATENT AND TRADEMARK OFFICE

CERTIFICATE OF CORRECTION

PATENT NO. : 5,018,484

DATED : May 28, 1991

INVENTOR(S) : Takao Naitoh

It is certified that error appears in the above-identified patent and that said Letters Patent is hereby corrected as shown below:

Column 11:

Claim 2, line 27, delete "value" and insert --valve--.

Signed and Sealed this

Twentieth Day of September, 1994

*Attest:*

*Attesting Officer*

BRUCE LEHMAN

*Commissioner of Patents and Trademarks*